US010589407B2

(12) United States Patent
Gaul

(10) Patent No.: US 10,589,407 B2
(45) Date of Patent: Mar. 17, 2020

(54) OPTIMIZED METHOD FOR SETTING EXPANSION ANCHORS BY MEANS OF A POWER TOOL

(71) Applicant: Hilti Aktiengesellschaft, Schaan (LI)

(72) Inventor: Hans-Dieter Gaul, Augsburg (DE)

(73) Assignee: Hilti Aktiengesellschaft, Schaan (LI)

( * ) Notice: Subject to any disclaimer, the term of this patent is extended or adjusted under 35 U.S.C. 154(b) by 90 days.

(21) Appl. No.: 15/503,254

(22) PCT Filed: Aug. 11, 2015

(86) PCT No.: PCT/EP2015/068420
§ 371 (c)(1),
(2) Date: Feb. 10, 2017

(87) PCT Pub. No.: WO2016/023886
PCT Pub. Date: Feb. 18, 2016

(65) Prior Publication Data

US 2017/0232597 A1 Aug. 17, 2017

(30) Foreign Application Priority Data

Aug. 12, 2014 (EP) ..... 14180636

(51) Int. Cl.
*B25B 31/00* (2006.01)
*B25B 21/02* (2006.01)
*B25B 23/147* (2006.01)

(52) U.S. Cl.
CPC ..... *B25B 31/00* (2013.01); *B25B 21/02* (2013.01); *B25B 23/1475* (2013.01)

(58) Field of Classification Search
CPC ..... B25B 31/00; B25B 19/00; B25B 23/1475
See application file for complete search history.

(56) References Cited

U.S. PATENT DOCUMENTS 7,770,658 B2 8/2010 Ito et al.
8,950,508 B2 2/2015 Hoop et al.
(Continued)

FOREIGN PATENT DOCUMENTS

CN 1695899 A 11/2005
CN 101466501 A 6/2009
(Continued)

OTHER PUBLICATIONS

Chinese Office Action issued in Chinese counterpart application No. 201580026570.0 dated Dec. 13, 2017, with English translation (Thirteen (13) pages).
(Continued)

*Primary Examiner* — Christopher M Koehler
*Assistant Examiner* — Kyle A Cook
(74) *Attorney, Agent, or Firm* — Crowell & Moring LLP

(57) ABSTRACT

A method for setting an expansion anchor by a power tool, and a power tool that performs the method, is disclosed. In an embodiment, the method includes exerting rotary impacts on the expansion anchor in order to expand an expansion sleeve in dependence on a first rotational speed until a tightening torque corresponds to a threshold value, exerting a predetermined number of rotary impacts on the expansion anchor in dependence on the first rotational speed, and exerting rotary impacts on the expansion anchor by the power tool in dependence on a generated second rotational speed for a predetermined period of time.

3 Claims, 2 Drawing Sheets

(56) References Cited

U.S. PATENT DOCUMENTS

| | | | | |
|---|---|---|---|---|
| 2005/0263305 | A1 | 12/2005 | Shimizu et al. | |
| 2009/0014192 | A1 | 1/2009 | Ito et al. | |
| 2009/0084568 | A1* | 4/2009 | Arimura | B25B 23/1405 173/104 |
| 2012/0132452 | A1 | 5/2012 | Hoop et al. | |
| 2012/0222876 | A1* | 9/2012 | Schmidt | B25B 21/02 173/1 |
| 2013/0153252 | A1* | 6/2013 | Sakakibara | B25B 21/008 173/1 |
| 2014/0374130 | A1 | 12/2014 | Nakamura et al. | |

FOREIGN PATENT DOCUMENTS

| | | | |
|---|---|---|---|
| CN | 101765483 | A | 6/2010 |
| DE | 10 2011 005 079 | A1 | 9/2012 |
| EP | 1 188 521 | A2 | 3/2002 |
| EP | 2 495 076 | A1 | 9/2012 |
| GB | 2 441 670 | A | 3/2008 |
| JP | 2005-324264 | A | 11/2005 |
| JP | 2006-315125 | A | 11/2006 |
| JP | 2010-247289 | A | 11/2010 |
| JP | 2012-111035 | A | 6/2012 |
| JP | 2013-188812 | A | 9/2013 |
| JP | 2014-020120 | A | 2/2014 |
| WO | WO 2013/136711 | A2 | 9/2013 |

OTHER PUBLICATIONS

PCT/EP2015/068420, International Search Report (PCT/ISA/220 and PCT/ISA/210) dated Nov. 20, 2015, with partial English translation, enclosing Written Opinion of the International Searching Authority (PCT/ISA/237) (Twelve (12) pages).

U.S. Patent Application, "Optimized Setting Method for Expansion Anchors", filed Feb. 10, 2017, Inventor: Hans-Dieter Gaul.

English Machine translation of JP 2010-247289 A2, (Five (5) pages).

English Machine translation of JP 2014-020120 A2, (Five (5) pages).

* cited by examiner

OPTIMIZED METHOD FOR SETTING EXPANSION ANCHORS BY MEANS OF A POWER TOOL

This application claims the priority of International Application No. PCT/EP2015/1068420, filed Aug. 11, 2015, and European Patent Document No. 14180636.4, filed. Aug. 12, 2014, the disclosures of which are expressly incorporated by reference herein.

BACKGROUND AND SUMMARY OF THE INVENTION

The present invention relates to a method for setting an expansion anchor by means of a power tool, in particular an impact screwdriver. The present invention further relates to a power tool, in particular an impact screwdriver performing this method, containing an input device for sensing a type of an expansion anchor or a tightening torque for the expansion anchor, a percussion mechanism for generating rotary impacts that can be transferred from and to the expansion anchor, a device for sensing a rotational angle of a drive shaft of the power tool and a control device.

Expansion anchors are used in a pre-drilled hole and are subsequently pre-stressed in the hole in a standard manner using a torque key. The use of a torque key has proven necessary since a user cannot see whether the expansion anchor expands correctly, i.e., is set when the expansion anchor is inserted into the hole. In this regard, problems occur in the case of excessively low expansion and thus lower resilience of the anchoring in the subgrade and also in the case of excessively high expansion, due to possible fatigue of the expansion anchor. The manufacturers of the expansion anchors accordingly indicate an associated tightening torque which should be adjusted on the torque key for setting.

A setting method for an expansion anchor and an impact screwdriver for setting an expansion anchor according to the prior art is for example disclosed in the German patent application DE 10 2011 005 079 A1. This document of the prior art describes a method for setting an expansion anchor by means of an impact screwdriver, in the case of which rotary impacts are repeatedly exerted on the expansion anchor. A repetition rate of the rotary impacts is adjusted in dependence on a tightening torque predefined for expanding an expansion sleeve of the expansion anchor. The impact screwdriver adjusts the exertion of rotary impacts when a sensed medium rotational speed at a nut of the expansion anchor falls below a threshold value.

In a series of tests, it was determined that the relaxation behavior of an expansion anchor is dependent on the setting speed by means of which the expansion anchor is positioned in a material (e.g., mineral subgrade). Relaxation here describes the gradual loss of pre-stress force of the expansion anchor set in a material due to setting effects.

In the case of expansion anchors that are set with high tightening speed, a very high decrease of the pro-stress force of the expansion anchor set in a material was observed in the first minutes after concluding the setting process. In the case of a conventional setting method (i.e., manually setting an expansion anchor in a material) with a torque key, this loss of pre-stress force is less pronounced. An increased loss of pre-stress force reduces the load values that can be achieved with the expansion anchor and thus limits the application field of the expansion anchor.

The loss of the pre-stress force is supposedly caused by the very high speed of the setting process. In the case of tightening by hand (i.e., in the case of manually setting an expansion anchor in a material), a torque is usually applied in a plurality of intervals over a period of time of approximately 20 seconds. In the breaks between these intervals, in which the return movement is performed with the torque key, local tension peaks in the material (e.g., concrete) may already be reduced. In the case of a further return movement or in the case of a further stroke by the torque key, the loss of pre-stress force resulting therefrom is again compensated.

In the case of setting using an impact screwdriver, the entire setting process of the expansion anchor is concluded within approximately 2 seconds. As a result, there is no time in order to reduce the tension peaks between the setting intervals. For this reason, the setting process takes place only after concluding the actual setting processes.

It is thus the object of the present invention to solve the problem described above and in particular to provide a method for setting an expansion anchor by means of a power tool, in particular an impact screwdriver, as well as to provide a power tool, in particular an impact screwdriver, for performing this method. The setting process of an expansion anchor is optimized by the method and the power tool for performing the method such that the expansion anchor can be subjected to the highest possible loading of tensile stress.

To this end, a method is provided for setting an expansion anchor by means of a power tool, in particular an impact screwdriver.

The method is characterized according to the invention by the steps:

exerting rotary impacts on an expansion anchor 1 by way of the power tool 20 to expand an expansion sleeve 3 of the expansion anchor 1 in dependence on a first rotational speed generated in the power tool 20 until a tightening torque generated in the power tool 20 and exerted on the expansion anchor 1 corresponds to a predetermined threshold value;

exerting a predetermined number of rotary impacts on the expansion anchor 1 by way of the power tool 20 to expand an expansion sleeve 3 of the expansion anchor 1 in dependence on a first rotational speed generated in the power tool 20; and exerting rotary impacts on the expansion anchor 1 by way of the power tool 20 to expand the expansion sleeve 3 of the expansion anchor 1 in dependence on a second rotational speed, generated in the power tool 20 and reduced in comparison to the first rotational speed, for a predetermined period of time (t).

By exerting further rotary impacts on the already set expansion anchor with a reduced rotational speed, a re-stressing may be generated on the expansion anchor, with the result that the setting effects can be balanced out without the pre-stress force in the expansion anchor being increased further.

Furthermore, a power tool, in particular an impact screwdriver, is provided for performing this method, containing an input device for sensing a type of an expansion anchor or a tightening torque for the expansion anchor, a percussion mechanism for generating rotary impacts that can be transferred from and to the expansion anchor, a device for sensing a tightening torque of the power tool and a control device.

According to the invention, the power tool is characterized in that the control device is configured to set a first rotational speed generated in the power tool, with the result that rotary impacts that are dependent on the first rotational speed can be exerted on the expansion anchor to expand an expansion sleeve of the expansion anchor until a tightening torque generated in the power tool and exerted on the expansion anchor corresponds to a predetermined threshold value; to set the power tool such that a predetermined number of rotary impacts is exerted by the power tool on the expansion anchor to expand the expansion sleeve of the expansion anchor in dependence on the first rotational speed generated in the power tool, and to set a second rotational speed, generated in the power tool and reduced in comparison to the first rotational speed, with the result that for a predetermined period of time rotary impacts that are dependent on the second rotational speed can be exerted on the expansion anchor to expand the expansion sleeve of the expansion anchor.

Re-stressing may be hereby generated on the expansion anchor, with the result that the setting effects can be balanced out without the pre-stress force in the expansion anchor being further increased.

Further advantages emerge from the following description of the figures. Different exemplary embodiments of the present invention are illustrated in the figures. The figures, the description and the claims contain numerous features in combination. The person skilled in the art will also expediently consider the features individually and combine them to form reasonable further combinations.

DETAILED DESCRIPTION OF THE DRAWINGS

Figure 1:
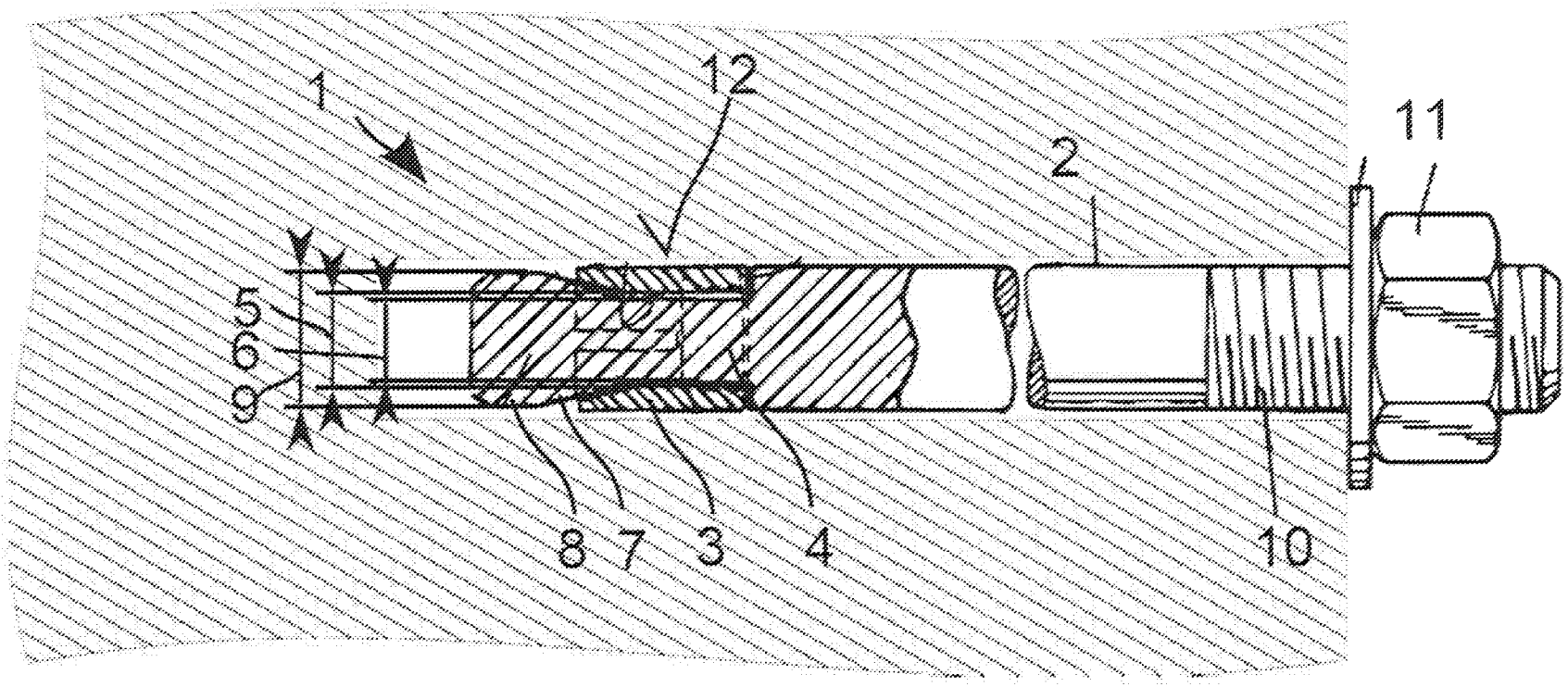
FIG. 1 shows an expansion anchor in a bore hole.
Figure 2:
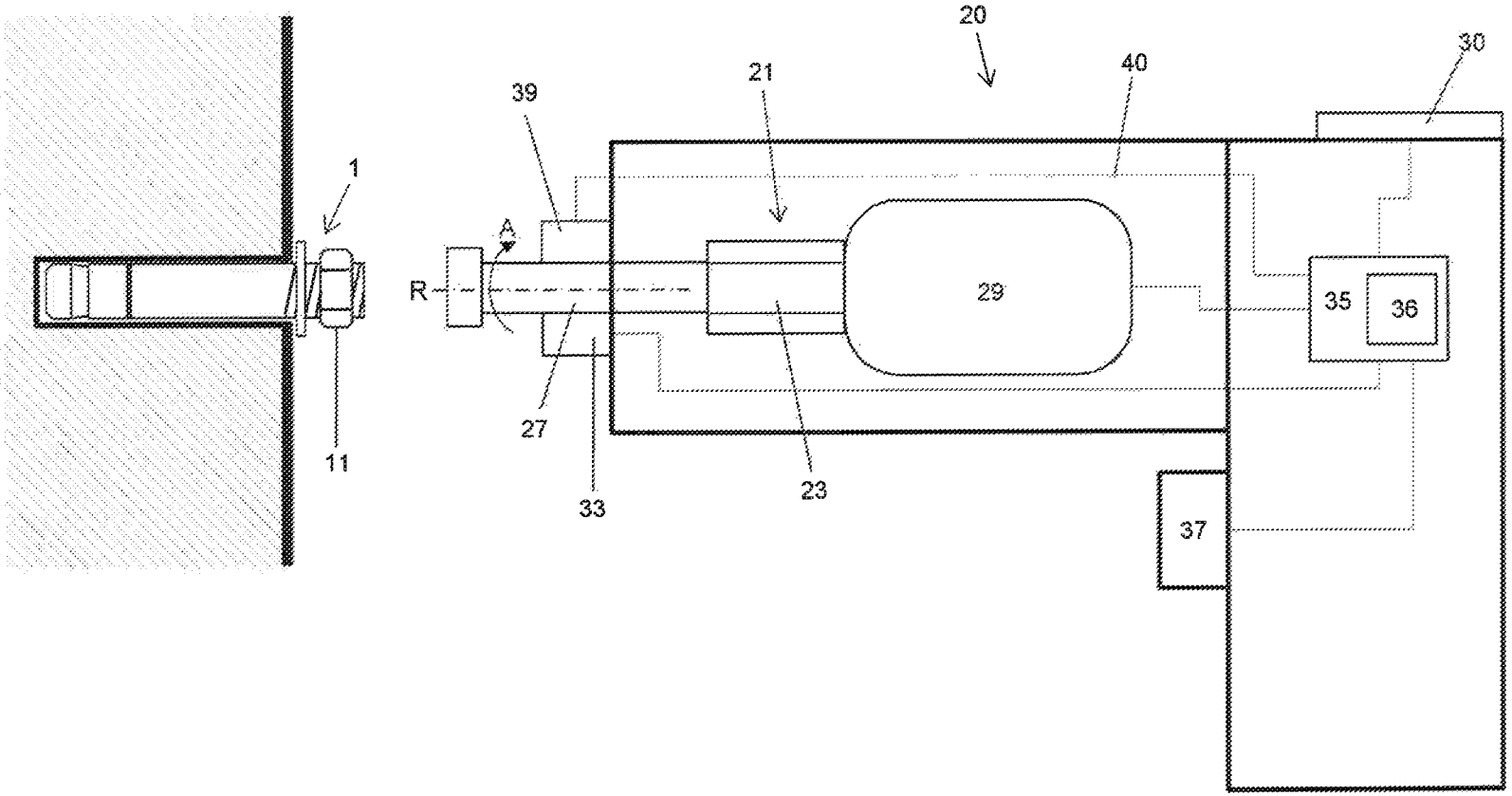
FIG. 2 shows a power tool according to the invention in the form of an impact screwdriver and an expansion anchor in a bore hole.

FIG. 1 shows an exemplary expansion anchor 1 consisting of a draw bar 2 and an expansion sleeve 3. The expansion sleeve 3 surrounds a cylindrical section 4 of the draw bar 2 at the circumference. An outer diameter 5 of the cylindrical section 4 is preferably somewhat smaller than an inner diameter 6 of the expansion sleeve 3, with the result that the draw bar 2 is axially movable towards the expansion element 3. The cylindrical section 4 passes into a conical section 7, which forms an expansion body 8 to expand the expansion sleeve 3. The largest diameter of the conical section 7 is larger than the inner diameter 6 of the expansion sleeve 3 and preferably smaller than an outer diameter 9 of the expansion sleeve 3. A thread 10 is provided on the draw bar 2, via which a tensile force may be introduced. In the case of the exemplary expansion anchor 1, the thread 10 also serves as securing means for loads. In the case of assembly, the expansion anchor 1 with the expansion body 8 is inserted beforehand into a bore hole with a diameter somewhat smaller than the outer diameter of the unexpanded expansion sleeve 3. A nut 11 is screwed onto the thread 10 and tightened until the draw bar 2 together with the expansion body 8 is drawn into the expansion sleeve 3. The expansion sleeve 3 is clamped to a wall 12 of the bore hole here. The expansion anchor 1 is correctly set when the expansion sleeve 3 is radially expanded by a determined amount. A user may identify this when the nut 11 can no longer be rotated with a specific tightening torque.

Other expansion anchors (not shown) may for example be a bolt with a counter thread which engages the thread 10 of the draw bar 2. In the case of assembly, the user places a screwdriver on the bolt and thereby draws the draw bar 2 with the expansion body 8 into the expansion sleeve 3.

The exemplary expansion anchor 1 may be set by means of an adapted impact screwdriver 20. To this end, the impact screwdriver 20 is connected in a known manner to the expansion anchor 1 such that the tightening torque that can be generated in the impact screwdriver 20 is correspondingly transferred to the expansion anchor 1 and in particular to the nut 11.

The impact screwdriver 20 has a percussion mechanism 21 which periodically generates rotary impacts in the rotation direction A. A hammer (not shown) is mounted on a drive shaft 23 by means of a spiral-shaped connecting member (not shown). A spring (not shown) presses the hammer along the drive shaft 23 in the direction towards an anvil (not shown). The anvil is rigidly connected to a drive shaft 27. The drive shaft 23 and the drive shaft 27 are rotatable relative to each other. The hammer and the anvil have protruding clips (not shown) along the drive shaft 23, via which the hammer can transfer a torque to the anvil. An electromotor 29 drives the drive shaft 23 via a transmission that is not shown. A cycle of a rotary impact substantially has the following phases. The clips of the hammer rest on the anvil. The rotating drive shaft 23 draws the hammer, owing to the connecting member, away from the anvil against the force of the spring until the clips are disengaged from the anvil. The hammer is moved in the direction towards the anvil driven by the springs and is in this regard placed by the connecting member into a rotational movement. The clips lastly impact tangentially on the anvil.

An embodiment of the impact screwdriver 20 has an input device 30 by means of which a user can input the special tightening torque of the expansion anchor 1. The input device 30 contains for example a button (not shown), a keyboard (not shown), a control panel (not shown) and/or a display element (not shown). Alternatively or additionally, an input device 30 may also be provided via which the user may set a type as well as the associated tightening torque for an expansion anchor. For example, two buttons are provided for selecting a type or a design of the expansion anchor and a size of the expansion anchor. The selected type of the expansion anchor as well as the associated tightening torque may for example be displayed in a display element configured as a display or via a plurality of LEDs.

A control device 35 reads the input tightening torque from the input device 30 or from the detection device 33. The detection device 33 may be implemented in the form of a scanner, a button element, an input field or similar form.

The control device 35 determines a first rotational speed for the drive shaft 23 by means of the input tightening torque. For example, rotational speeds assigned to different tightening torques are stored in a storage device 36. After a user activates the electromotor 29 by means of a button (not shown), the control device 35 checks whether a rotational speed has been previously predefined, thus, for example, by inputting the expansion anchor type or the tightening torque. The control device 35 may for example prevent the motor 29 from activating, if a tightening torque has not yet been selected, but rather prompts the user to carry out an input. The control device 35 regulates the electromotor 29 such that the drive shaft 23 rotates with the predefined first rotational speed. The selected first rotational speed of the drive shaft 23 predefines the repetition rate of the rotary impacts. It has been recognized that with a decrease of the rotational speed, not only does the frequency of the rotary impacts decrease, which is irrelevant for the setting of the expansion anchor, but also that the torque exerted with each rotary impact is reduced. A torque is assigned to each of the rotational speeds, namely with a large tolerance. In one configuration, the impact screwdriver 20 begins to rotate the nut 11 with a maximum possible rotational speed for the impact screwdriver. After a period of time, which is preferably determined by the type of the expansion anchor 1 that is input, the impact screwdriver decreases the rotational speed to the rotational speed predefined in dependence on the tightening torque. The tightening torque is the tightening torque predetermined for the respectively used expansion anchor.

A device 39 for sensing a tightening torque of the power tool 20 is arranged on the drive shaft 27. In the illustrated embodiment, the device 39 is implemented for sensing a tightening torque of the power tool 20 by a torque transducer. The torque transducer 39 serves to sense the tightening torque on the drive shaft 27 which is generated by the power tool 20 and in particular by the electromotor 29. The torque transducer 39 may in this regard contain strain gauges and/or function according to the piezoelectric, magnetoelastic or optical principle. Alternatively or in addition thereto, the torque transducer may also work using the SAW method (surface acoustic wave method). The sensed tightening torque of the drive shaft 27 around a rotational axis R is transferred via a connection conduit 40 to the control device 35. The control device 35 compares the tightening torque sensed by the torque transducer 39 with threshold values for the tightening torque stored in the storage device 36. When the tightening torque sensed by the torque transducer 39 reaches a predetermined threshold value, then this is an indicator that the expansion anchor can no longer continue to be rotated with the rotary impacts exerted thereon or with the tightening torque of the impact screwdriver set to the first rotational speed acting thereon and is correctly set in the bore hole. According to an embodiment not shown and not further described, a torque transducer is not necessarily provided since the tightening torque for the expansion anchor may be determined or estimated indirectly from the motor rotational angle using a corresponding device.

Then, a predetermined number of rotary impacts is exerted on the expansion anchor 1 by the power tool 20. The fixed number of additional rotary impacts serves to further expand the expansion sleeve 3 of the expansion anchor 1, and these additional rotary impacts are generated in dependence on the first rotational speed generated in the power tool 20.

Subsequently the control device 35 sets the electromotor such that a second rotational speed is applied for the drive shaft 23. The second rotational speed is in this regard lower than the first rotational speed. The second or lower rotational speed generates rotary impacts with a correspondingly lower tightening torque which is exerted on the expansion anchor for a predetermined period of time t. Re-stressing of the expansion anchor may be thereby generated, with the result that the setting effects can be balanced out without the pre-stress force in the expansion anchor being further increased.

By way of the method according to the invention and the power tool 20 for performing this method, the setting process of the expansion anchor 1 is thus optimized such that the expansion anchor 1 can be subjected to the highest possible loading of tensile force in the bore hole.

The invention claimed is:

1. A method for setting an expansion anchor in a bore hole by a power tool, comprising the steps of:

exerting in succession a first series of rotary impacts on the expansion anchor by the power tool and expanding an expansion sleeve of the expansion anchor in the bore hole in dependence on a first rotational speed generated in the power tool until the first series of rotary impacts can no longer rotate the expansion anchor and a tightening torque generated in the power tool and exerted on the expansion anchor corresponds to a predetermined threshold value, wherein when the tightening torque generated in the power tool and exerted on the expansion anchor corresponds to the predetermined threshold value the expansion anchor is correctly set in the bore hole;

following the step of exerting in succession the first series of rotary impacts on the expansion anchor by the power tool and expanding the expansion sleeve of the expansion anchor in dependence on the first rotational speed generated in the power tool, waiting a period of time for relaxation to occur in the expansion anchor then exerting a predetermined number of additional rotary impacts on the set expansion anchor by the power tool and further expanding the set expansion sleeve of the expansion anchor in dependence on the first rotational speed generated in the power tool; and following the step of exerting the predetermined number of additional rotary impacts on the set expansion anchor by the power tool, then exerting rotary impacts on the set expansion anchor by the power tool and expanding the expansion sleeve of the expansion anchor in dependence on a second rotational speed, generated in the power tool and reduced in comparison to the first rotational speed, for a predetermined period of time.

2. The method according to claim 1, wherein the power tool is an impact screwdriver.

3. A method for setting an expansion anchor in a bore hole by a power tool, comprising the steps of:

exerting in succession a first series of first rotary impacts on the expansion anchor by the power tool with a first rotational speed of the power tool until the first series of first rotary impacts can no longer rotate the expansion anchor and a tightening torque generated in the power tool and exerted on the expansion anchor corresponds to a predetermined threshold value, wherein when the tightening torque generated in the power tool and exerted on the expansion anchor corresponds to the predetermined threshold value the expansion anchor is correctly set in the bore hole;

following the step of exerting in succession the first series of first rotary impacts on the expansion anchor by the power tool, waiting a period of time for relaxation to occur in the expansion anchor then exerting a predetermined number of additional first rotary impacts on the set expansion anchor by the power tool with the first rotational speed; and after the step of exerting the predetermined number of additional first rotary impacts, exerting second rotary impacts on the set expansion anchor by the power tool with a second rotational speed, wherein the second rotational speed is less than the first rotational speed.

* * * * *